US006424133B1

(12) United States Patent
Choi

(10) Patent No.: US 6,424,133 B1
(45) Date of Patent: Jul. 23, 2002

(54) CONTROL VOLTAGE GENERATOR AND METHOD FOR GENERATING CONTROL VOLTAGE HAVING PHASE DIFFERENCE

(75) Inventor: Hyeong Sik Choi, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/012,392

(22) Filed: Dec. 12, 2001

(30) Foreign Application Priority Data

Jul. 9, 2001 (KR) ..... 01-40901

(51) Int. Cl.[7] ..... G05F 1/40; G05F 1/44; G05F 1/56

(52) U.S. Cl. ..... 323/288; 323/282; 323/285

(58) Field of Search ..... 323/288, 285, 323/282, 284

(56) References Cited

U.S. PATENT DOCUMENTS 5,627,460 A * 5/1997 Bazinet et al. ..... 323/288
5,949,229 A * 9/1999 Choi et al. ..... 323/320
5,982,156 A * 11/1999 Weiner et al. ..... 323/222
6,011,706 A * 1/2000 Adaragna et al. ..... 363/41
6,066,943 A * 5/2000 Hastings et al. ..... 323/285
6,246,220 B1 * 6/2001 Isham et al. ..... 323/224
6,329,802 B1 * 12/2001 Feldman ..... 323/288

* cited by examiner

*Primary Examiner*—Bao Q. Vu
(74) *Attorney, Agent, or Firm*—Robert E. Bushnell, Esq.

(57) ABSTRACT

A control voltage generator and a related method generate control voltages having a phase difference. The control voltage generator includes first thru N-th loads (where N is a positive integer no less than 2), and is installed in an electronic device that may experience noise or malfunction when signals having the same phase are simultaneously inputted into the loads. In the control voltage generator, a sawtooth generator generates and outputs a sawtooth signal. and a first driving signal generator compares the sawtooth signal generated by the sawtooth generator with an input signal having information as to the degree of variation of an inherent level, which relates to an inherent function of the electronic device. The comparison result is outputted as a first driving signal. The control voltage generator also includes second thru N-th driving signal generators. An n-th driving signal generator (where $2 \leqq n \leqq N$) compares the input signal with the sawtooth signal, and outputs the comparison result as an n-th driving signal, the first thru N-th driving signals having different phases are provided to the first thru N-th loads, respectively, as control voltages, and the electronic device varies the inherent level in response to the control voltages. Therefore, it is possible to prevent unnecessary power consumption in the electronic device. In addition, it is possible to prevent the generation of noise and malfunction of the electronic device in advance, and it is also possible to increase the durability and reliability of the electronic device by preventing surges.

24 Claims, 4 Drawing Sheets

FIG. 2
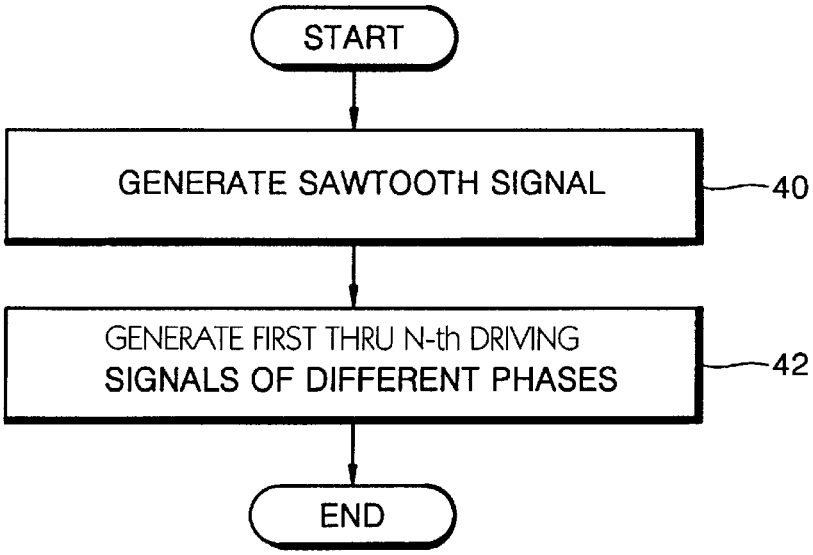
FIG. 3A
FIG. 3B
FIG. 3C
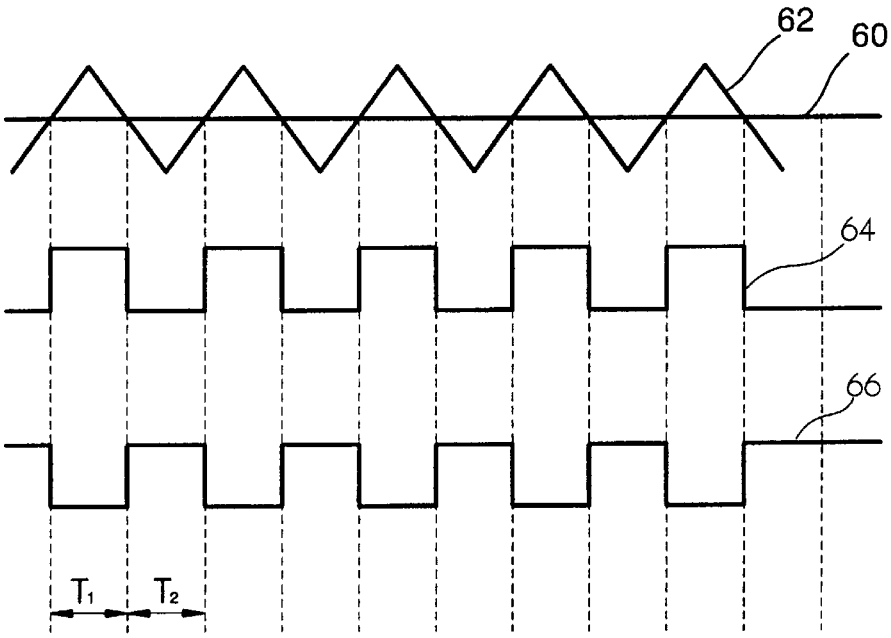

CONTROL VOLTAGE GENERATOR AND METHOD FOR GENERATING CONTROL VOLTAGE HAVING PHASE DIFFERENCE

CLAIM OF PRIORITY

This application makes reference to, incorporates the same herein, and claims all benefits accruing under 35 U.S.C. §119 from my application APPARATUS AND METHOD FOR GENERATING CONTROL VOLTAGE HAVING PHASE DIFFERENCE filed with the Korean Industrial Property Office on Jul. 9, 2001 and there duly assigned Ser. No. 40901/2001.

BACKGROUND OF THE INVENTION

1. Technical Field

The present invention relates to the control of an electronic device such as an image displayer or a fly-back transformer (FBT) and, more particularly, to a control voltage generator which generates control voltages for controlling the electronic device. and a method for generating the control voltages.

2. Related Art

A control voltage generator generates control voltages, which have the same amplitude, the same frequency, and the same phase. and provides such control voltages to loads. Then, an electronic device adjusts the level of brightness or the level of a high voltage or a high current in response to the control voltages inputted into loads. If the control voltages are simultaneously provided to the loads, an excessive amount of current may flow into the loads. Accordingly, the electronic device having the control voltage generator may make noise, may malfunction, or may consume unnecessary power. For example, when the electronic device having the control voltage generator is an image displayer, a screen on which images are displayed may flicker. In addition, when control voltages having the same phase are simultaneously provided to the loads, the electronic device may make noise due to interference occurring between the loads.

SUMMARY OF THE INVENTION

To solve the above-described problems, it is a first object of the present invention to provide a control voltage generator which is capable of generating control voltages having different phases for controlling an electronic device.

It is a second object of the present invention to provide a method for generating a control voltage using the above control voltage generator.

Accordingly, to achieve the first object, there is provided a control voltage generator, which includes first thru N-th loads (where N is a positive integer no less than 2), and which is installed in an electronic device that may make noise or malfunction when signals having the same phase are simultaneously input into the loads. The control voltage generator includes: a sawtooth generator which generates and outputs a sawtooth signal; a first driving signal generator which compares the sawtooth signal generated by the sawtooth generator with an input signal having information as to the degree of variation in the level of a predetermined signal, which directly corresponds to a typical function of the electronic device, and which outputs the result as a first driving signal; and second thru N-th driving signal generators. Preferably, an n-th driving signal generator (where $2 \leqq n \leqq N$) compares the input signal with the sawtooth signal and outputs the result as an n-th driving signal. The first thru N-th driving signals are provided as control voltages to the first thru N-th loads, respectively, and the electronic device varies the level of the predetermined signal in response to the control voltages.

To achieve the second object, there is provided a method for generating control voltages, which have phase differences, using the control voltage generator. The method includes generating a sawtooth signal, comparing an input signal with the sawtooth signal. and generating first thru N-th driving signals with different phases.

BRIEF DESCRIPTION OF THE DRAWINGS

A more complete appreciation of the invention, and many of the attendant advantages thereof. will be readily apparent as the same becomes better understood by reference to the following detailed description when considered in conjunction with the accompanying drawings, in which like reference numerals indicate the same or similar components, and wherein:

FIG. 2 is a flow chart illustrating a method for generating a control voltage according to the present invention by using the control voltage generator shown in FIG. 1;

FIGS. 3A thru 3C are diagrams illustrating the waveforms of signals inputted into/outputted from each element of the control voltage generator shown in FIG. 1;

DETAILED DESCRIPTION OF THE INVENTION

The present invention will now be described more fully with reference to the accompanying drawings, in which preferred embodiments of the invention are provided.

Figure 1:
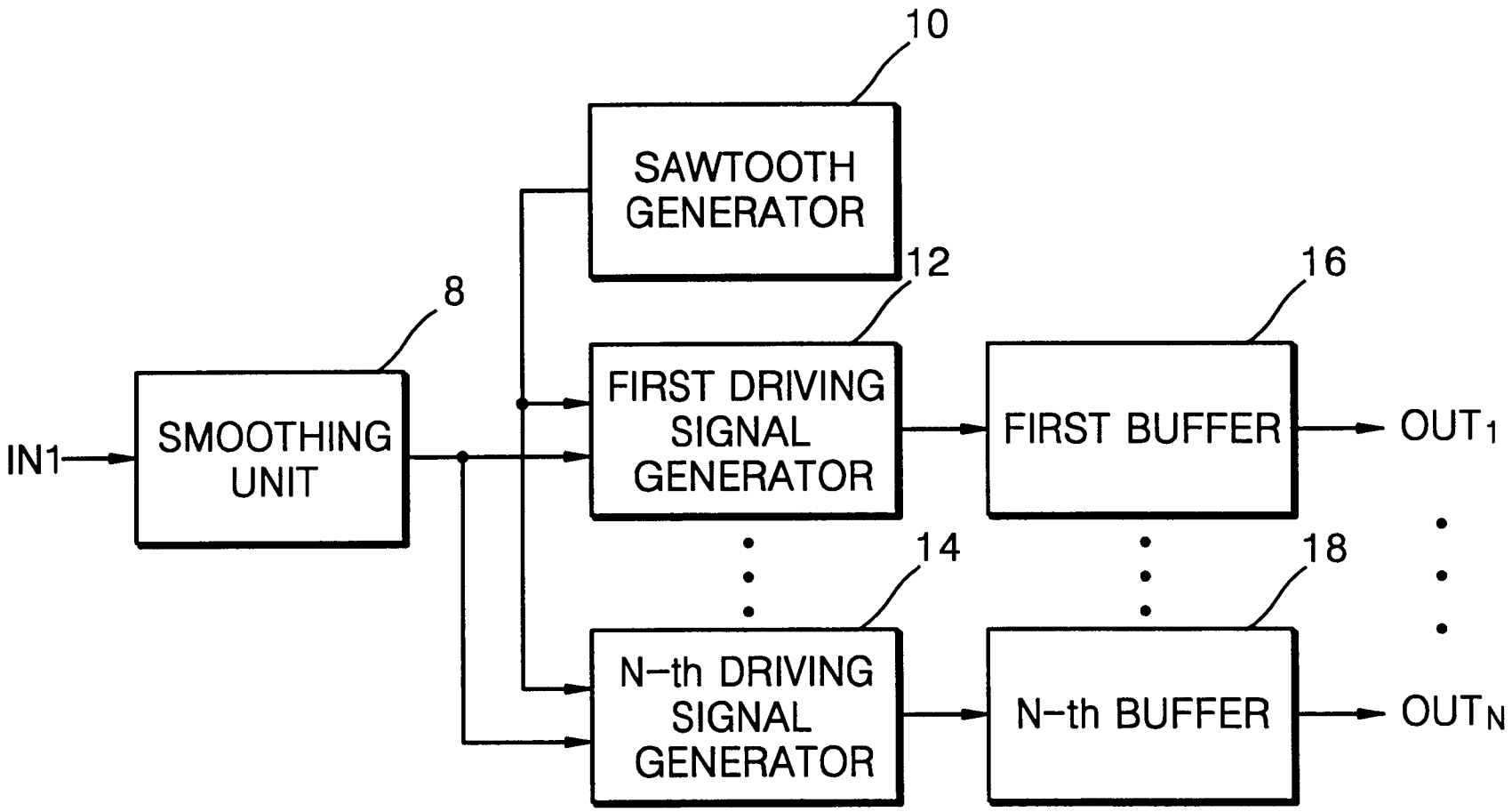
FIG. 1 is a block diagram illustrating a control voltage generator according to the present invention.

FIG. 1 is a block diagram illustrating a control voltage generator for generating control voltages having a phase difference according to the present invention. The control voltage generator includes a smoothing unit 8, a sawtooth generator 10, first thru N-th driving signal generators 12, . . . , 14 (where N is a positive integer no less than 2), and first thru N-th buffers 16, . . . , 18.

FIG. 2 is a flow chart illustrating a method for generating a control voltage according to the present invention by using the control voltage generator shown in FIG. 1. The method for generating control voltage includes the steps of generating a sawtooth signal (step 40) and generating first thru N-th driving signals of different phases (step 42).

The control voltage generator according to the present invention is installed in an electronic device which includes first thru N-th loads (not shown), and may make noise or malfunction when control voltages having the same phase are simultaneously input into the first thru N-th loads. The electronic device may be an image displayer which varies the level of brightness of an image to be displayed in response to a control voltage generated by the control voltage generator according to the present invention. The image displayer may be a liquid crystal display (LCD), a plasma display panel (PDP), or a cathode ray tube (CRT). Alternatively, the electronic device may be a fly-back transformer (FBT) which generates a high voltage or a high current, the level of which is varied in accordance with the control voltage generated by the control voltage generator according to the present invention.

FIGS. 3A thru 3C are diagrams illustrating the waveforms of signals inputted to/outputted from each element of the control voltage generator shown in FIG. 1. Specifically, FIG. 3A is a diagram illustrating the waveforms of an input signal 60 and a sawtooth signal 62, FIG. 3B is a diagram illustrating the waveform of a first driving signal 64, and FIG. 3C is a diagram illustrating the waveform of an n-th driving signal 66 (where $2 \leqq n \leqq N$).

In the method for generating a control voltage according to the present invention, the sawtooth generator 10 generates the sawtooth signal 62 shown in FIG. 3A and then outputs the sawtooth signal 62 to the first thru N-th driving signal generators 12, . . . , 14 in step 40. Hereinafter, the structure and operation of an embodiment of the sawtooth signal generator 10 will be described.

Figure 4:
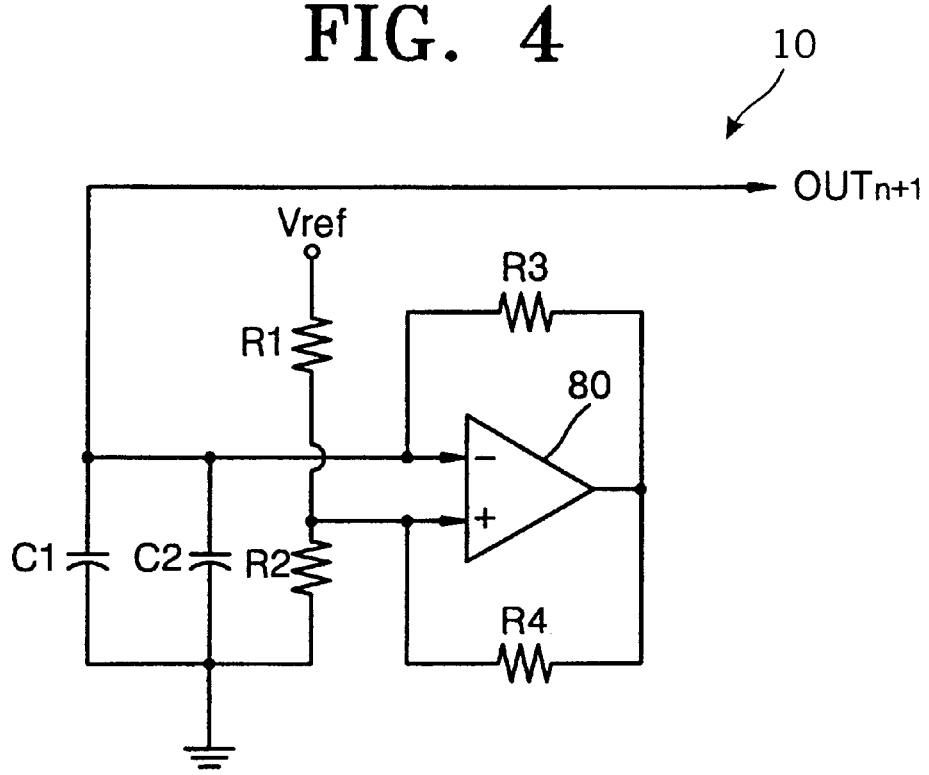
FIG. 4 is a circuit diagram illustrating an embodiment of the sawtooth generator of FIG. 1 according to the present invention.

FIG. 4 is a circuit diagram illustrating the sawtooth generator 10 of FIG. 1. Referring to FIG. 4, the sawtooth generator 10 includes first. second, third, and fourth resistors R1, R2, R3 and R4, respectively, first and second capacitors C1 and C2, respectively, and an operational amplifier 80.

A first end of the first resistor R1 is connected to a predetermined voltage Vref, and a second end of the first resistor R1 is connected to a positive input terminal (+) of the operational amplifier 80. The second resistor R2 is connected between the second end of the first resistor R1 and a reference potential i.e., ground voltage. The operational amplifier 80 includes a positive input terminal (+) to which the second end of the first resistor R1 is connected, and a negative input terminal (−) to which the sawtooth signal 62 outputted via an output terminal $OUT_{n+1}$ is connected. The third resistor R3 is connected between the output terminal and the negative input terminal (−) of the operational amplifier 80, and the fourth resistor R4 is connected between the output terminal and the positive input terminal (+) of the operational amplifier 80. The first and second capacitors C1 and C2, respectively, are connected in parallel between the negative input terminal (−) of the operational amplifier 80 and the ground (reference potential). Here, the fourth resistor R4 may be realized as a variable resistor in order to precisely control the frequency of the sawtooth signal 62 outside the sawtooth generator 10 in accordance with needs of a user.

According to an embodiment of the present invention, after step 40, the first thru N-th driving signal generators 12, . . . , 14 shown in FIG. 1 compare the input signal 60 and the sawtooth signal 62, which are shown in FIGS. 3A–3C, and generates first thru N-th driving signals in step 42. The first thru N-th driving signals are square wave signals having the same amplitude and frequency but different phases. To perform step 42, the first driving signal generator 12 compares the input signal 60 and the sawtooth signal 62 input from the sawtooth generator 10, and outputs the comparison result as the first driving signal 64 shown in FIG. 3B. At the same time, each of the second thru N-th driving signal generators compares the input signal 60 shown in FIG. 3A and the sawtooth signal 62 from the sawtooth generator 10, and outputs the comparison result as the n-th driving signal 66 shown in FIG. 3C.

For example, the first driving signal generator 12 generates the first driving signal 64 shown in FIG. 3B, which is logic 'high' when the level of input signal 60 is lower than the level of the sawtooth signal 62, and which is logic 'low' when the level of the input signal 60 is higher than the level of the sawtooth signal 62. The n-th driving signal generator generates the n-th driving signal 66 shown in FIG. 3C, which is logic 'high' when the level of the input signal 60 is higher than the level of the sawtooth signal 62. and which is logic 'low' when the level of the input signal 60 is lower than the level of the sawtooth signal 62. Accordingly, the first driving signal 64 shown in FIG. 3B and the n-th driving signal 66 shown in FIG. 3C have the same amplitude and the same frequency, but have a phase difference of 180 degrees. In addition, there is a predetermined phase difference among the second thru N-th driving signals. For example, in a case where N=3, the first and second driving signals may have a phase difference of 60 degrees, and the second and third driving signals may also have a phase difference of 60 degrees.

The input signal 60 provided to the first thru N-th driving signal generators 12, . . . , 14 has information as to the degree of variation of the inherent level of a signal (hereinafter, referred to as "the inherent level"), which relates to an inherent function of an electronic device. The inherent level and the inherent function may be different depending on the kind and structure of an electronic device, including the control voltage generator according to the present invention. For example, where the electronic device is an image displayer, the inherent function of the electronic device corresponds to displaying of images, and the inherent level corresponds to the level of brightness of the displayed image. On the other hand, where the electronic device is a fly-back transformer (FBT), the inherent function of the electronic device means that the FBT generates a high voltage or a high current, and the inherent level corresponds to the level of the high voltage or the high current generated by the FBT.

The control voltage generator according to the present invention further includes a smoothing unit 8 in order for generating the input signal 60. Here, the smoothing unit 8 receives and smoothes a pulse width modulation (PWM) signal, via input terminal IN1, the PWM signal having a pulse width proportional to the degree to which the inherent level is varied. The smoothing unit 8 outputs the smoothing result to the first thru N-th driving signal generators 12, . . . , 14 as the input signal 60. Alternatively. the smoothing unit 8 receives and smoothes an analog signal via input terminal IN1, the analog signal having an amplitude proportional to the degree to which the inherent level is varied. The smoothing unit 8 then outputs the smoothing result to the first thru N-th driving signal generators 12, . . . , 14 as the input signal 60. The smoothing unit 8 can be implemented by a resistor and a capacitor. Thus, the smoothing unit 8 integrates the analog signal or the PWM signal with the use of the resistor and the capacitor, and outputs the result of integration as a result of smoothing the analog signal or the PWM signal. The information in the input signal 60 corresponds to the variation in the width of the PWM signal or the amplitude of the analog signal.

For example, in the case of an image displayer, a microcontroller (not shown) included in the image displayer outputs to the smoothing unit 8 a PWM signal which has a wide pulse width so as to increase the level of brightness of an image to be displayed, or which has a narrow pulse width so as to decrease the level of brightness of an image to be displayed. Alternatively, the microcontroller (not shown) outputs to the smoothing unit 8 an analog signal which has a high amplitude so as to increase the level of brightness of an image to be displayed, or which has a low amplitude so as to decrease the level of brightness of an image to be displayed.

On the other hand, in the case of a fly-back transformer (FBT), the FBT outputs to the smoothing unit 8 a PWM signal which has a wide pulse width so as to increase the level of a high voltage or a high current to be generated, or which has a narrow pulse width so as to decrease the level of a high voltage or a high current to be generated. Alternatively, the FBT outputs to the smoothing unit 8 an analog signal which has a high amplitude so as to increase the level of a high voltage or a high current to be generated, or which has a low amplitude so as to decrease the level of a high voltage or a high current to be generated.

When a PWM signal having a wide pulse width is inputted to the smoothing unit 8, the smoothing unit 8 increases the level of the input signal 60. On the other hand, when a PWM signal having a narrow pulse width is inputted to the smoothing unit 8, the smoothing unit 8 decreases the level of the input signal 60. Alternatively, when an analog signal having a high amplitude is inputted to the smoothing unit 8, the smoothing unit 8 increases the level of the input signal 60. On the other hand, when an analog signal having a low amplitude is inputted to the smoothing unit 8, the smoothing unit 8 decreases the level of the input signal 60. Accordingly, as shown in FIG. 3A, when the level of the input signal 60 decreases, the pulse width T1 of the first or n-th driving signal increases, whereas the pulse width T2 of the first or n-th driving signal decreases. When the level of the input signal 60 increases, the pulse width T1 of the first or n-th driving signal decreases, whereas the pulse width T2 of the first or n-th driving signal increases. For example, the level of the input signal 60 varies within a range of 0–5 Volts.

The first thru N-th driving signals generated in step 42 are provided to the first thru N-th loads as control voltages, and then an electronic device varies the inherent level in response to the pulse widths T1 and T2 of the first thru N-th driving signals. Here, the first thru N-th loads may be different depending on the inherent function and structure of an electronic device. For example, where the image displayer is a cathode-ray tube (CRT), each of the first thru N-th loads corresponds to a horizontal or vertical coil of a deflection yoke (DY) in the CRT. Where the image displayer is a liquid crystal display (LCD), each of the first thru N-th loads corresponds to a lamp of the LCD. Where the image displayer is a plasma display panel (PDP), each of the first thru N-th loads corresponds to an electrode of the PDP. In the case of an FBT, each of the first thru N-th loads corresponds to a secondary part of the FBT.

Hereinafter, the structure and operation of each of the first thru N-th driving signal generators 12, . . . , 14, which generate the first thru N-th driving signals in step 42, will be described with reference to the accompanying drawings.

Figure 5:
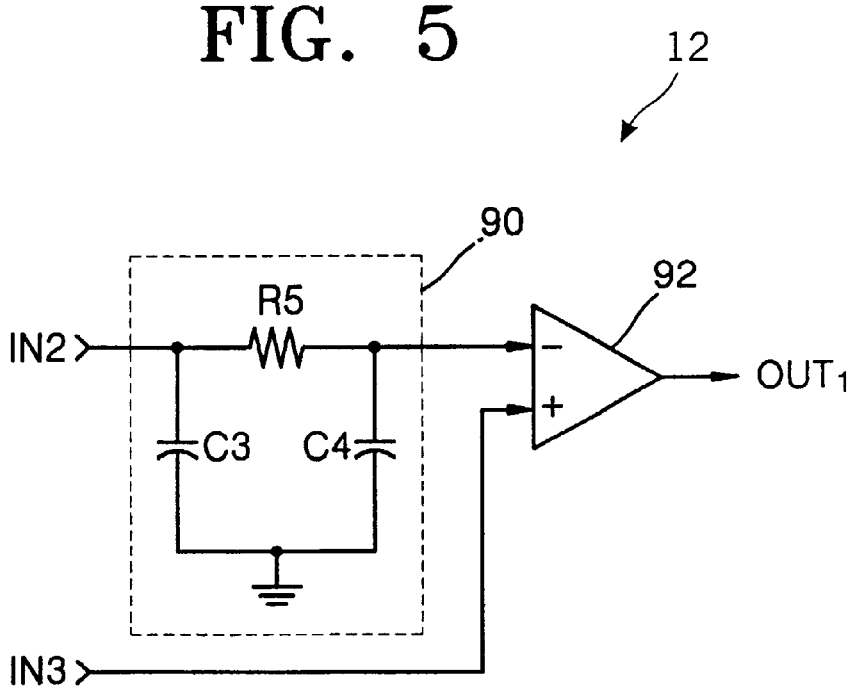
FIG. 5 is a circuit diagram illustrating an embodiment of the first driving signal generator of FIG. 1 according to the present invention.

FIG. 5 is a circuit diagram illustrating an embodiment of the first driving signal generator of FIG. 1 according to the present invention.

According to an embodiment of the present invention, as shown in FIG. 5, the first driving signal generator 12 includes a noise remover 90 and a first comparator 92. The noise remover 90 removes noise from the input signal 60, inputted via input terminal IN2, and outputs the result to a negative input terminal (–) of the first comparator 92. Then, the first comparator 92 compares the output signal of the noise remover 90 with the sawtooth signal 62, inputted to a positive input terminal (+) of the first comparator 92 via an input terminal IN3, and outputs the comparison result as a first driving signal via an output terminal $OUT_1$.

As shown in FIG. 5, the noise remover 90 includes a fifth resistor R5, a third capacitor C3, and a fourth capacitor C4. The input signal 60, inputted to the noise remover 90 via the input terminal IN2, is applied to one end of the fifth resistor R5, and the input signal 60 from which noise is removed is applied to the other end of the fifth resistor R5. The third capacitor C3 is connected between the one end of the fifth resistor R5 and ground (reference potential). The fourth capacitor C4 is connected between the other end of the fifth resistor R5 and the ground. The noise remover 90 has a structure such that it corresponds to a p-type low pass filter.

According to another embodiment of the present invention, a first driving signal generator, unlike the first driving signal generator 12 shown in FIG. 5, may include only the first comparator 92. Here, the comparator 92 compares the input signal 60, inputted to its negative input terminal (–) via the input terminal IN2, with the sawtooth signal 62 inputted to its positive input terminal (+) via the input terminal IN3, and outputs the comparison result as a first driving signal via the output terminal $OUT_1$.

Figure 6:
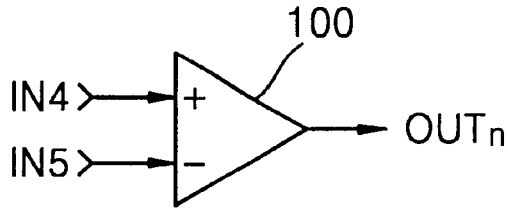
FIG. 6 is a block diagram illustrating an embodiment of the n-th driving signal generator (where n=2) of FIG. 1 according to the present invention.

FIG. 6 is a block diagram illustrating an embodiment of an n-th driving signal generator (where n=2) of FIG. 1 according to the present invention.

According to an embodiment of the present invention, as shown in FIG. 6, the n-th driving signal generator is realized as a second comparator 100 which has a positive input terminal (+) to which the input signal 60 is input via an input terminal IN4, a negative input terminal (–) to which the sawtooth signal 62 is input via an input terminal IN5, and an output terminal $OUT_n$ from which an n-th driving signal is output. Here, the second comparator 100 compares the level of the input signal 60 with the level of the sawtooth signal 62, and outputs the comparison result as the n-th driving signal via the output terminal $OUT_n$.

According to another embodiment of the present invention, the n-th driving signal generator may be realized as the second comparator 100, which includes a positive input terminal (+) to which the output of the noise remover 90 is provided via the input terminal IN4, a negative input terminal (–) to which the sawtooth signal 62 is provided via the input terminal IN5, and an output terminal $OUT_n$ from which the n-th driving signal is outputted. The second comparator 100 compares the level of the input signal 60 with the level of the sawtooth signal 62, and outputs the comparison result as the n-th driving signal via the output terminal $OUT_n$.

According to still another embodiment of the present invention, the first driving signal generator 12 compares the input signal 60 and the sawtooth signal 62 shown in FIG. 3A, and generates a first driving signal. The second thru N-th driving signal generators each invert the input signal 60 for N−1 different time periods. Then, the second thru N-th driving signal generators compare their respective results of inverting the input signal 60 with the sawtooth signal 62, and generate the comparison results as the second thru N-th driving signals, respectively, in step 42 of FIG. 2. The time taken for each of the second thru N-th driving signal generators to invert the input signal 60 is different, so that the second thru N-th driving signals generated by the second thru N-th driving signal generators, respectively, have different phases, and thus there is a phase difference among the second thru N-th driving signals.

Hereinafter the structure and operation of an n-th driving signal generator according to the present invention will be described.

Figure 7:
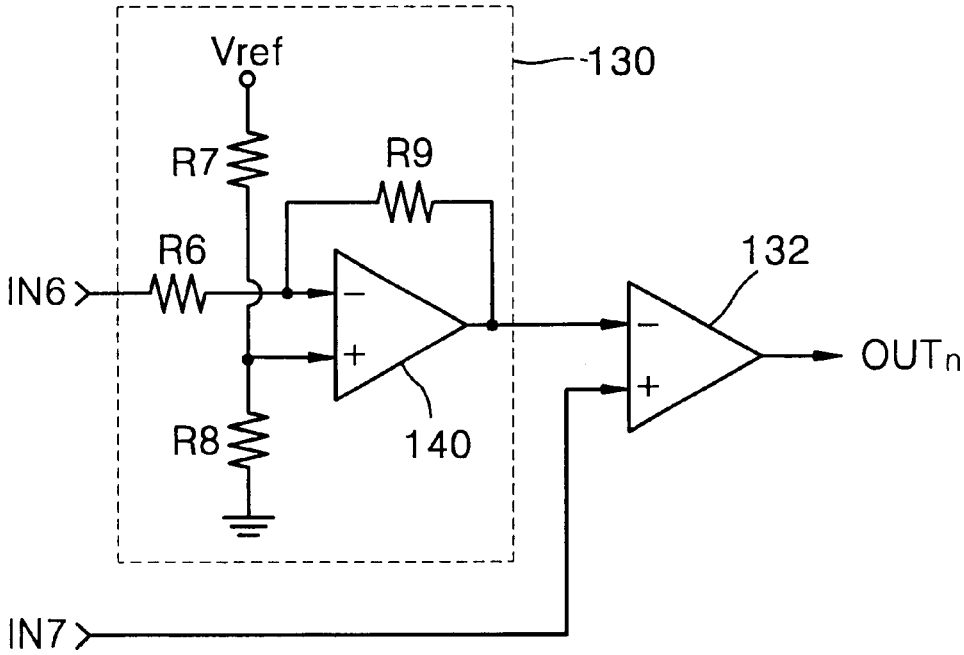
FIG. 7 is a circuit diagram illustrating an embodiment of the n-th driving signal generator of FIG. 1 according to the present invention.

FIG. 7 is a circuit diagram illustrating an embodiment of an n-th driving signal generator of FIG. 1 according to the present invention. Referring to FIG. 7, the n-th driving signal generator includes an inverter 130 and a third comparator 132.

The inverter 130 inverts the input signal 60 provided via an input terminal IN6, or the input signal 60 from which noise is already removed by the noise remover 90, and outputs the inverted result to a negative input terminal (−) of the third comparator 132. The inverter 130 also acts as a buffer. In other words, the inverter 130 inverts the input signal 60 provided via the input terminal IN6, or the input signal 60 from which noise is already removed by the noise remover 90, while driving the input signal 60. The third comparator 132 includes a negative input terminal (−) to which the output signal of the inverter 130 is provided, a positive input terminal (+) to which the sawtooth signal 62 is provided via an input terminal IN7, and an output terminal $OUT_n$ from which the n-th driving signal is output. The third comparator 132 having such a structure compares the output signal of the inverter 130 with the sawtooth signal 62, and outputs the comparison result as the n-th driving signal via the output terminal $OUT_n$.

The control voltage generator shown in FIG. 1 can further have first thru N-th buffers 16, . . . , 18. The first buffer 16 receives and buffers the first driving signal generated by the first driving signal generator 12, and outputs the buffered result via the output terminal $OUT_1$. The n-th buffer receives and buffers the n-th driving signal generated by the n-th driving signal generator, and outputs the buffered result via the output terminal $OUT_n$. Here. the results of buffering the first thru N-th driving signals in the first thru N-th buffers 16, . . . , 18 are provided to the first thru N-th loads (not shown), respectively, as control voltages. The first or n-th buffer may be realized as a bipolar transistor (not shown) which includes a base to which the first or n-th driving signal is applied, a collector to which a control voltage is applied, and an emitter which is connected to the ground voltage.

An amplifier (not shown) and capacitors (not shown) maybe included between each of the first thru N-th buffers 16, . . . , 18 and each of the first thru N-th loads (not shown). In that case, the amplifier (not shown) amplifies the result of buffering a driving signal, and outputs the buffered result to the capacitors (not shown). The capacitors (not shown) prevent surges, and are connected in parallel between each amplifier (not shown) and its respective load (not shown).

As described above, the control voltage generator and the method for generating control voltages can generate control voltages with different phases, which will be provided to first thru N-th loads (not shown), thereby preventing unnecessary power consumption in an electronic device. In addition, it is possible to prevent generation of noise and malfunction in the electronic device in advance, and it is also possible to increase the durability and reliability of the electronic device by preventing surges, which may occur when control voltages having the same phase are provided to loads.

What is claimed is:

1. A control voltage generator, which includes first thru N-th loads and which is installed in an electronic device which is susceptible to at least one of noise and malfunction when signals having the same phase are simultaneously inputted to the loads, the control voltage generator comprising:

a sawtooth generator which generates and outputs a sawtooth signal;

a first driving signal generator which compares the sawtooth signal generated by the sawtooth generator with an input signal having information as to a degree of variation of an inherent level which relates to an inherent function of the electronic device, and which outputs a comparison result as a first driving signal; and second thru N-th driving signal generators;

wherein an n-th driving signal generator (where $2 \leqq n \leqq N$) compares the input signal with the sawtooth signal, and outputs the comparison result as an n-th driving signal, wherein the first thru N-th driving signals have different phases and are provided to the first thru N-th loads, respectively, as control voltages, and wherein the electronic device varies the inherent level in response to the control voltages.

2. The control voltage generator of claim 1, wherein the sawtooth generator comprises:

a first resistor having a first end connected to a predetermined voltage, and a second end;

a second resistor connected between the second end of the first resistor and a reference potential;

an operational amplifier having a positive input terminal connected to the second end of the first resistor, and a negative input terminal to which the sawtooth signal is applied;

a third resistor connected between an output terminal of the operational amplifier and the negative input terminal of the operational amplifier;

a fourth resistor connected between the output terminal of the operational amplifier and the positive input terminal of the operational amplifier; and first and second capacitors connected in parallel between the negative input terminal of the operational amplifier and the reference potential.

3. The control voltage generator of claim 2, wherein the fourth resistor is a variable resistor.

4. The control voltage generator of claim 1, wherein the first driving signal generator comprises a comparator having a negative input terminal to which the input signal is provided as an input, a positive input terminal to which the sawtooth signal is provided as an input, and an output terminal from which the first driving signal is outputted.

5. The control voltage generator of claim 1, wherein the first driving signal generator further comprises a noise remover which removes noise from the input signal to produce a noise remover output which is compared with the sawtooth signal to produce the comparison result, the comparison result being outputted as the first driving signal.

6. The control voltage generator of claim 5, wherein the n-th driving signal generator comprises a further comparator having a positive input terminal to which the input signal is provided as an input, a negative input terminal to which the sawtooth signal is provided as an input, and an output terminal from which the n-th driving signal is outputted.

7. The control voltage generator of claim 5, wherein the n-th driving signal generator comprises:

an inverter which inverts the noise remover output to produce an inverted noise remover output, and which outputs the inverted noise remover output; and a comparator having a negative input terminal to which the inverted result is provided as an input, a positive input terminal to which the sawtooth signal is provided as an input, and an output terminal from which an n-th driving signal is outputted.

8. The control voltage generator of claim 5, wherein the noise remover comprises:

a resistor which has a first end to which the input signal is provided as an input, and a second end to which the noise remover output is provided as an input;

a first capacitor connected between the first end of the resistor and a reference potential; and a second capacitor connected between the second end of the resistor and the reference potential.

9. The control voltage generator of claim 4, wherein the n-th driving signal generator comprises an additional comparator having a positive input terminal to which the input signal is provided as an input. a negative input terminal to which the sawtooth signal is provided as an input, and an output terminal from which the n-th driving signal is outputted.

10. The control voltage generator of claim 4, wherein the n-th driving signal generator comprises:

an inverter which inverts the input signal to obtain an inverted result, and which outputs the inverted result; and an additional comparator having a negative input terminal to which the inverted result is provided as an input, a positive input terminal to which the sawtooth signal is provided as an input, and an output terminal from which the n-th driving signal is outputted.

11. The control voltage generator of claim 1, further comprising first thru N-th buffers;

wherein the first buffer buffers the first driving signal, the second thru N-th buffers buffer the second thru N-th driving signals, respectively, to produce buffered results, and the buffered results are provided to the first thru N-th loads as the control voltages.

12. The control voltage generator of claim 11, wherein at least one of the buffers is a bipolar transistor having a base to which one of the driving signals is applied, a collector which is connected to the control voltage, and an emitter which is connected to a reference potential.

13. The control voltage generator of claim 1. wherein the electronic device is an image displayer which varies a level of brightness of an image to be displayed in response to the control voltage, the inherent function is to display the image, and the inherent level is the level of the brightness of the image.

14. The control voltage generator of claim 13, wherein the image displayer is a cathode-ray tube (CRT), and each of the first thru N-th loads is one of a horizontal coil and a vertical coil of a deflection yoke in the cathode-ray tube (CRT) which inputs the control voltage.

15. The control voltage generator of claim 13, wherein the image displayer is a plasma display panel (PDP), and each of the first thru N-th loads is an electrode of the plasma display panel (PDP) which inputs the control voltage.

16. The control voltage generator of claim 13, wherein the image displayer is a liquid crystal display (LCD), and each of the first thru N-th loads is a lamp of the liquid crystal display (LCD) which inputs the control voltage.

17. The control voltage generator of claim 1, wherein the electronic device is a fly-back transformer (FBT) which generates one of a high voltage and a high current having a level which is varied in response to the control voltage, the inherent function is to generate said one of the high voltage and the high current, and the inherent level is the level of said one of the high voltage and the high current.

18. The control voltage generator of claim 17, wherein each of the first thru N-th loads is a secondary part of the fly-back transformer (FBT).

19. The control voltage generator of claim 1, further comprising a smoothing unit which smoothes a pulse width modulation signal having a width proportional to a degree of variation of the inherent level, and outputs the smoothing result as the input signal; and wherein the information corresponds to the variation of the width of the pulse width modulation signal.

20. A method for generating control voltages having phase differences, the method comprising the steps of:

(a) generating the control voltages based on an input signal;

(b) generating a sawtooth signal; and (c) comparing the input signal with the sawtooth signal, and generating first thru N-th driving signals with different phases;

wherein the input signal has information as to a degree of variation of an inherent level, which relates to an inherent function of an electronic device.

21. The method of claim 20, wherein in step (c) the first driving signal is generated by comparing the input signal with the sawtooth signal, and the second thru N-th driving signals are generated by comparing a result of inverting the input signal for N−1 different time periods of the sawtooth signal.

22. The method of claim 20, further comprising the step of removing noise from the input signal prior to step (c).

23. The method of claim 22, further comprising the step of inverting the input signal after the noise is removed and prior to step (c).

24. The method of claim 20, further comprising the step of inverting the input signal prior to step (c).

* * * * *